US010941718B2

(12) United States Patent
Shinagawa et al.

(10) Patent No.: US 10,941,718 B2
(45) Date of Patent: Mar. 9, 2021

(54) EVAPORATED FUEL PROCESSING APPARATUS

(71) Applicant: AISAN KOGYO KABUSHIKI KAISHA, Obu (JP)

(72) Inventors: Masanobu Shinagawa, Nagoya (JP); Yoshihiko Honda, Obu (JP); Hiroyuki Takahashi, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/668,027

(22) Filed: Oct. 30, 2019

(65) Prior Publication Data

US 2020/0158037 A1 May 21, 2020

(51) Int. Cl.

*F02M 25/08* (2006.01)
*F02D 41/00* (2006.01)
*F02M 35/10* (2006.01)

(52) U.S. Cl.

CPC ..... *F02D 41/003* (2013.01); *F02M 25/0818* (2013.01); *F02M 25/0836* (2013.01); *F02M 25/0854* (2013.01); *F02M 25/0872* (2013.01); *F02M 35/10222* (2013.01); *F02D 2200/50* (2013.01)

(58) Field of Classification Search

CPC ..... F02M 25/08; F02M 25/0809; F02M 25/0818; F02M 25/0827; F02M 25/0836; F02M 2025/0845; F02M 25/089

See application file for complete search history.

(56) References Cited

U.S. PATENT DOCUMENTS 5,371,412 A * 12/1994 Iwashita ..... F02M 25/08 290/1 R
5,632,251 A * 5/1997 Ishikawa ..... F02M 25/0854 123/519
6,161,423 A * 12/2000 Okuma ..... F02M 25/0818 123/520
6,389,882 B1 * 5/2002 Ohkuma ..... F02M 25/0818 73/114.39
9,097,216 B2 * 8/2015 Itoh ..... F02M 25/0818
2001/0050104 A1 * 12/2001 Nishi ..... F16K 24/044 137/202
2020/0271065 A1 * 8/2020 Ahn ..... F02M 25/0836

FOREIGN PATENT DOCUMENTS

JP 2016-023584 A 2/2016

* cited by examiner

*Primary Examiner* — Thomas N Moulis
(74) *Attorney, Agent, or Firm* — Oliff PLC

(57) ABSTRACT

An evaporated fuel processing apparatus preventing evaporated fuel from being discharged out of a canister when residual purge gas is made to return to the canister and processed is provided. In the apparatus, an ECU performs residual purge gas processing operation of returning the residual purge gas into the canister and processing during halt of purge control. This operation includes a residual purge gas pressure-feeding process of pressure-feeding the residual purge gas with the air into the canister by the purge pump in a state in which the atmospheric passage is shut off and the purge passage and the second bypass passages are opened and an air discharge process of discharging the air in the canister outside via the atmospheric passage by opening the atmospheric passage while the purge passage and the second bypass passage are shut off.

9 Claims, 7 Drawing Sheets

FIG. 5

BACKFLOW MODE COMPLETION PRESSURE VALUE

| ASSUMPTION<br>TANK VOLUME :60L<br>OTHER VOLUME:2L<br>(CANISTER+PIPE) | FUEL AMOUNT | SYSTEM SPACE AMOUNT | BACKFLOW RATE[L] | | |
|---|---|---|---|---|---|
| | | | 0.5L | 1.0L | 2.0L |
| | 0L | 62L | 0.8kPa | 1.6kPa | 3.3kPa |
| | 25L | 37L | 1.4kPa | 2.7kPa | 5.5kPa |
| | 50L | 12L | 4.2kPa | 8.4kPa | 16.9kPa |

EVAPORATED FUEL PROCESSING APPARATUS

CROSS-REFERENCE TO RELATED APPLICATIONS

This application is based upon and claims the benefit of priority from the prior Japanese Patent Application No. 2018-218310 filed on Nov. 21, 2018, the entire contents of which are incorporated herein by reference.

BACKGROUND

Technical Field

The present disclosure relates to an evaporated fuel processing apparatus that makes flow evaporated fuel generated in a fuel tank into an internal combustion engine which processes the evaporated fuel.

Related Art

An evaporated fuel processing apparatus in Patent Document 1 is configured to process residual purge gas by driving a purge pump to reversely rotate during halt of purge control so that the residual purge gas remaining in a purge pipe is fed into a canister with the air. The evaporated fuel included in the residual purge gas is then adsorbed by an adsorbent in the canister and the air is discharged out to the atmosphere from the canister.

RELATED ART DOCUMENTS

Patent Documents

Patent Document 1: JP 2016-23584 A

SUMMARY

Technical Problems

Herein, the adsorbent in the canister has the characteristics that the lower a flow speed of gas inside the canister is, the larger a desorption amount of the evaporated fuel from the adsorbent becomes. Accordingly, in an apparatus described in the Patent Document 1, only reverse rotation of the purge pump while the residual purge gas is returned to the canister and processed may cause decrease in the flow speed of the air in the canister having a larger flow-passage area than the purge pipe, and thus the evaporated fuel may be desorbed from the adsorbent and discharged outside.

The present disclosure has been made to address the above-mentioned problem and has a purpose of providing an evaporated fuel processing apparatus that can prevent the evaporated fuel from being discharged outside from the canister when the residual purge gas is made to return to the canister.

Means of Solving the Problems

One aspect of the present disclosure to solve the above problem provides an evaporated fuel processing apparatus comprising: a canister provided with an adsorbent to adsorb evaporated fuel generated in a fuel tank; a purge passage connected to an intake passage, which is connected to an internal combustion engine, and a canister; and a controller to carry out purge control of feeding purge gas including the evaporated fuel into the intake passage from the canister via the purge passage, wherein the apparatus includes: a pressure-feeding part; an air introduction passage to introduce the air from the intake passage to the pressure-feeding part; and an atmospheric passage having one end connected to the canister and the other end opening in the atmosphere, the controller is configured to perform residual purge gas processing operation by returning the residual purge gas that is the purge gas remaining in the purge passage and processing during halt of the purge control, the residual purge gas processing operation includes: a residual purge gas pressure-feeding process of pressure-feeding the residual purge gas with the air into the canister by the pressure-feeding part in a state in which the atmospheric passage is shut off and the air introduction passage is opened; and an air discharge process of discharging the air from the canister to the outside through the atmospheric passage by opening the atmospheric passage in a state in which the air introduction passage is shut off after the residual purge gas and the air of predetermined volume are pressure-fed by the pressure-feeding part in the residual purge gas pressure-feeding process.

According to the above aspect, in the residual purge gas pressure-feeding process, the residual purge gas is pressure-fed to the canister while the atmospheric passage is shut off, and thus the evaporated fuel is prevented from being discharged outside the canister through the atmospheric passage. Further, the residual purge gas is pressure-fed to the canister with the air and then the canister is pressurized while the atmospheric passage is shut off in the residual purge gas pressure-feeding process, and thereafter, this atmospheric passage is opened in the air discharge process to discharge the air outside the canister through the atmospheric passage. Accordingly, in the air discharge process, the flow speed of the air is increased and a term for air discharge is shortened, thus restraining heat conduction from the air to the adsorbent in the canister, so that the temperature of the adsorbent is hard to increase. This can prevent desorption of the evaporated fuel from the adsorbent in the canister, and thus the evaporated fuel is hardly discharged outside the canister through the atmospheric passage in the air discharge process. As a result of this, the evaporated fuel is prevented from being discharged outside the canister when the residual purge gas is returned to the canister and processed.

In the above aspect, preferably, the pressure-feeding part is a purge pump provided in the purge passage to pressure-feed the purge gas in one direction from an intake port to an exhaust port, the evaporated fuel processing apparatus comprises: a first trifurcated valve provided in the purge passage between the exhaust port of the purge pump and the intake passage; a second trifurcated valve provided in the purge passage between the intake port of the purge pump and the canister; a first bypass passage detouring the purge pump between the first trifurcated valve and the canister; a second bypass passage detouring the purge pump between the purge passage, which is located between the first trifurcated valve and the intake passage, and the second trifurcated valve; and an atmospheric passage open/close valve provided in the atmospheric passage to open and close the atmospheric passage, the controller controls the atmospheric passage open/close valve to open and controls the purge pump to drive such that the purge gas inside the canister is pressure-fed to the intake passage in a state in which the exhaust port of the purge pump is communicated with the intake passage via the purge passage by the first trifurcated valve and the intake port of the purge pump is communicated with the canister via the purge passage by the second trifurcated valve in the purge control process of carrying out the purge control, and the controller controls the atmospheric passage open/close valve to close and controls the purge pump to drive such that the residual purge gas is pressure-fed to the canister in a state in which the exhaust port of the purge pump is communicated with the canister via the first bypass passage by the first trifurcated valve, and the intake port of the purge pump is communicated with the intake passage via the second bypass passage by the second trifurcated valve in the residual purge gas pressure-feeding process.

According to the above aspect, the purge pump configured to pressure-feed the purge gas only in one direction is used to pressure-feed the purge gas inside the canister to the intake passage, and further, the residual purge gas in the purge passage is pressure-fed to the canister. Accordingly, a configuration of the evaporated fuel processing apparatus is simplified and switching of pressure-feeding directions of the purge gas can be performed in a short time.

In the above aspect, preferably, when a route formed by the purge passage between the purge pump and the first trifurcated valve, the first bypass passage, the canister, and the atmospheric passage between the canister and the atmospheric passage open/close valve is defined as a pump downstream-side pressure-feeding route, the controller determines whether pressure-feeding of the residual purge gas and the air of predetermined volume by the purge pump in the residual purge gas pressure-feeding process is completed based on a pressure detected value detected in the pump downstream-side pressure-feeding route.

According to the above aspect, each amount of the residual purge gas and the air which are to be pressure-fed to the canister is controlled, and thus inside of the canister can be pressurized to a desired pressure value.

In the above aspect, preferably, the controller determines completion of pressure-feeding of the residual purge gas and the air of the predetermined volume by the purge pump when the pressure detected value is equal to or more than a predetermined value, and the more a fuel amount in the fuel tank connected to the canister is, the higher the predetermined value is set.

According to the above aspect, the amount of the residual purge gas and the air which are to be pressure-fed to the canister can be controlled according to the amount of the fuel in the fuel tank. Accordingly, irrespective of the fuel amount in the fuel tank, inside of the canister can be stably pressurized to the desired pressure value.

In the above aspect, preferably, the controller performs the residual purge gas processing operation at a predetermined timing after an ignition switch provided in a vehicle mounted with the evaporated fuel processing apparatus is turned off.

According to the above aspect, after the ignition switch is turned off, return operation of the residual purge gas to the canister is repeated at the predetermined timing. This enables effective removal of the residual purge gas from the purge passage. Further, the evaporated fuel to be discharged (leaked) out of the intake passage (an injector or the like) can be returned to the canister from the intake passage through the purge passage, thus restraining a discharge amount of the evaporated fuel discharged to the atmosphere during vehicle parking.

In the above aspect, preferably, when a route formed by the purge passage between the purge pump and the first trifurcated valve, the first bypass passage, the canister, and the atmospheric passage between the canister and the atmospheric passage open/close valve is defined as a pump downstream-side pressure-feeding route, the controller performs at least any one of leakage detection in the pump downstream-side pressure-feeding route and malfunction detection of at least any one of the first trifurcated valve, the second trifurcated valve, and the atmospheric passage open/close valve based on a pressure detection value in the pump downstream-side pressure feeding route.

According to the above aspect, the malfunction detection of the evaporated fuel processing apparatus can be performed. Further, by controlling each amount of the residual purge gas and the air which are to be pressure-fed to the canister based on the pressure detected value in the pump downstream-side pressure-feeding route, control of the amount of the residual purge gas and the air which are to be pressure-fed to the canister and the malfunction detection of the evaporated fuel processing apparatus can be both performed by use of the single pressure sensor. This achieves simplification of the configuration of the evaporated fuel processing apparatus.

According to the evaporated fuel processing apparatus of the present disclosure, when the residual purge gas is made to return to the canister and processed, the evaporated fuel can be prevented from being discharged outside the canister.

BRIEF DESCRIPTION OF THE DRAWINGS

FIG. 5 is a table showing one example of a backflow mode completion pressure value;

DETAILED DESCRIPTION OF THE EXEMPLARY EMBODIMENTS

An embodiment of an evaporated fuel processing apparatus of the present disclosure will be explained in detail below.

(Overview of Engine System)

Figure 1:
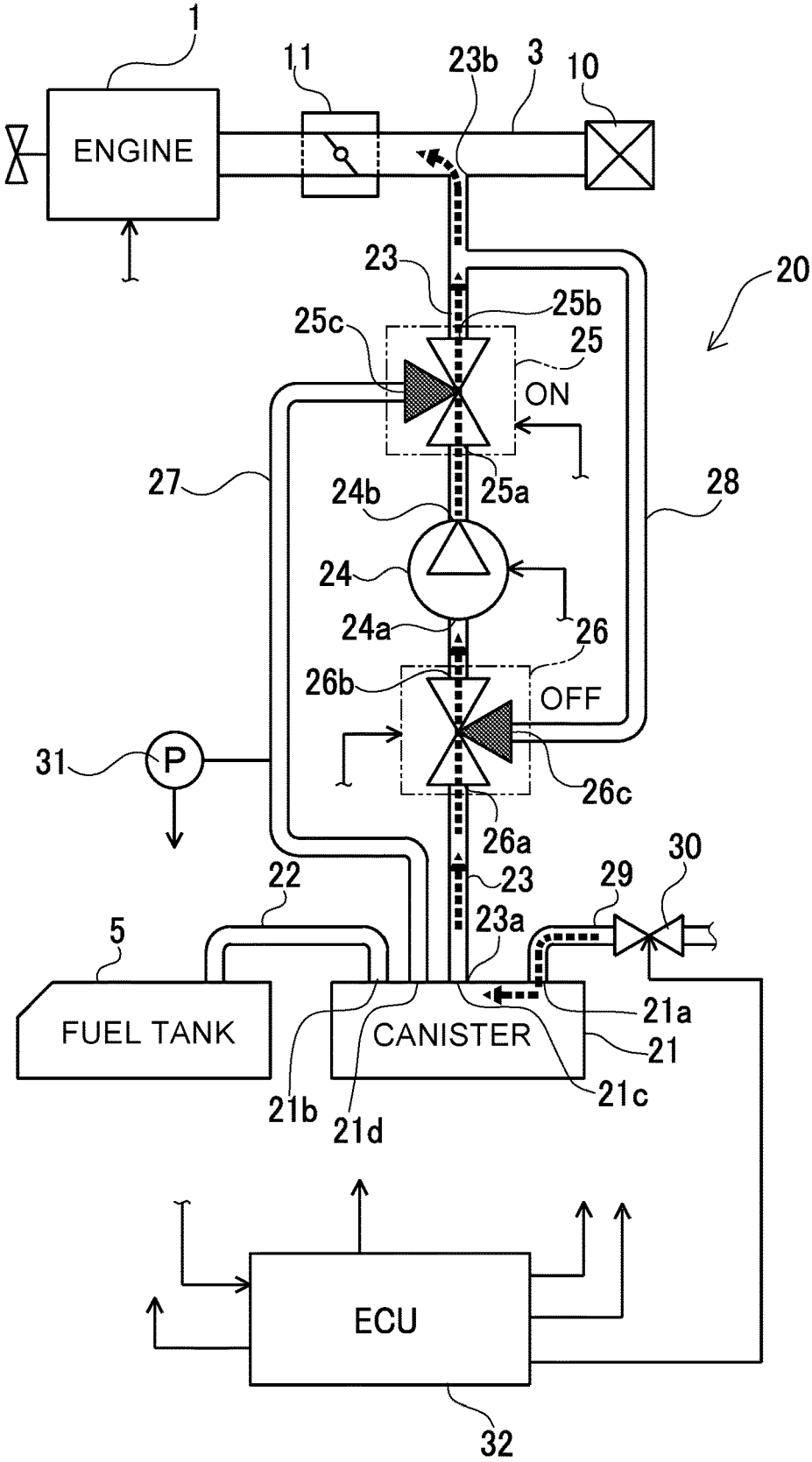
FIG. 1 is a schematic configurational view of an engine system including an evaporated fuel processing apparatus of the present embodiment, illustrating a purge control process.

An engine system including an evaporated fuel processing apparatus 20 of the present embodiment is firstly explained. As shown in FIG. 1, to an engine 1 (one example of an "internal combustion engine" of the present disclosure), an intake passage 3 for taking the air and others into a combustion chamber (not shown) of the engine 1 is connected. Further, fuel in a fuel tank 5 is supplied to this combustion chamber of the engine 1. Specifically, the fuel in the fuel tank 5 is discharged to a fuel passage (not shown) by a fuel pump (not shown) embedded in the tank 5 and then pressure-fed to an injector (not shown) provided in an intake port of the engine 1. The fuel thus pressure-fed to the injector is injected through the injector and further introduced to the combustion chamber together with the air that has flown in the intake passage, so that combustible air-fuel mixture is formed and used for combustion. The engine 1 is provided with an ignition device (not shown) to ignite the combustible air-fuel mixture.

In the intake passage 3, an air cleaner (A/C) 10 and a throttle device (THR) 11 are provided in this order from an inlet side of the intake passage 3 to the engine 1. The throttle device 11 includes a throttle valve (not shown) that opens and closes to regulate an intake flow rate of intake air flowing through the intake passage 3. Opening and closing operation of the throttle valve is associated with operation of an accelerator pedal (omitted its illustration) by a driver.

(Overview of Evaporated Fuel Processing Apparatus)

Next, the evaporated fuel processing apparatus 20 of the present embodiment is explained. As shown in FIG. 1, the evaporated fuel processing apparatus 20 includes a canister 21, a vapor passage 22, a purge passage 23, a purge pump 24 (one example of a "pressure-feeding part" of the present disclosure), a first trifurcated valve 25, a second trifurcated valve 26, a first bypass passage 27, a second bypass passage 28, and an atmospheric passage 29.

The canister 21 is a container for storing evaporated fuel generated in the fuel tank 5 and the canister 21 is provided with an adsorbent (not shown) such as activated carbon to adsorb the evaporated fuel. This canister 21 is further provided with an atmospheric port 21*a* to introduce the atmosphere from the atmospheric passage 29, an inflow port 21*b* to introduce the evaporated fuel from the vapor passage 22, an outflow port 21*c* through which the purge gas including the evaporated fuel is brought out, and a communication port 21*d* communicated with the first bypass passage 27.

The vapor passage 22 is a passage connected to the fuel tank 5 and the canister 21 to introduce the evaporated fuel from the fuel tank 5 to the canister 21.

The purge passage 23 is a passage connected to the intake passage 3 and the canister 21 to feed the purge gas from the canister 21 to the intake passage 3. This purge passage 23 is provided with an inflow port 23*a* to introduce the purge gas from the canister 21 and an outflow port 23*b* through which the purge gas is brought out to the intake passage 3. The inflow port 23*a* is connected with the outflow port 21*c* of the canister 21. The outflow port 23*b* is connected with the intake passage 3 between the air cleaner 10 and the throttle device 11.

The purge pump 24 is a device (such as a centrifugal pump) provided in the purge passage 23 to pressure-feed the purge gas from the canister 21 to the purge passage 23 during prosecution of purge control. This purge pump 24 is provided with an intake port 24*a* and a discharge port 24*b* and configured to pressure-feed the purge gas in only one direction from the intake port 24*a* to the discharge port 24*b*. Specifically, the purge pump 24 takes in the purge gas from the intake port 24*a* and discharges the purge gas through the discharge port 24*b*.

The first trifurcated valve 25 is, for example, an electric-motor operated valve and is provided in the purge passage 23 between the discharge port 24*b* of the purge pump 24 and the intake passage 3 (the outflow port 23*b* of the purge passage 23). This first trifurcated valve 25 is provided with an inlet 25*a* and a first outlet 25*b* which are connected to the purge passage 23 and a second outlet 25*c* connected to the first bypass passage 27. By switching passages of the first trifurcated valve 25, communication state is switched between a first communication state in which the inlet 25*a* and the first outlet 25*b* are communicated and a second communication state in which the inlet 25*a* and the second outlet 25*c* are communicated. In the present embodiment, the first communication state is established by turning on the first trifurcated valve 25 and the second communication state is established by turning off the first trifurcated valve 25.

The second trifurcated valve 26 is, for example, an electric-motor operated valve and provided in the purge passage 23 between the intake port 24*a* of the purge pump 24 and the canister 21 (the inflow port 23*a* of the purge passage 23). This second trifurcated valve 26 is provided with a first inlet 26*a* and an outlet 26*b* which are connected to the purge passage 23 and a second inlet 26*c* connected to the second bypass passage 28. By switching passages of the second trifurcated valve 26, communication state is switched between a first communication state in which the outlet 26*b* and the second inlet 26*c* are communicated and a second communication state in which the first inlet 26*a* and the outlet 26*b* are communicated. In the present embodiment, the first communication state is established by turning on the second trifurcated valve 26 and the second communication state is established by turning off the second trifurcated valve 26.

The first bypass passage 27 is a passage detouring the purge pump 24 between the first trifurcated valve 25 and the canister 21. The second bypass passage 28 is a passage detouring the purge pump 24 between a part of the purge passage 23, which is located between the first trifurcated valve 25 and the intake passage 3, and the second trifurcated valve 26.

The atmospheric passage 29 has one end connected to the canister 21 and the other end opening in the atmosphere. The atmospheric passage 29 is further provided with a DCV 30 (one example of an "atmospheric passage open/close valve" of the present disclosure) for opening and closing the atmospheric passage 29.

Further, the first bypass passage 27 is provided with a pressure sensor 31 to detect pressure in the first bypass passage 27.

Figure 6:
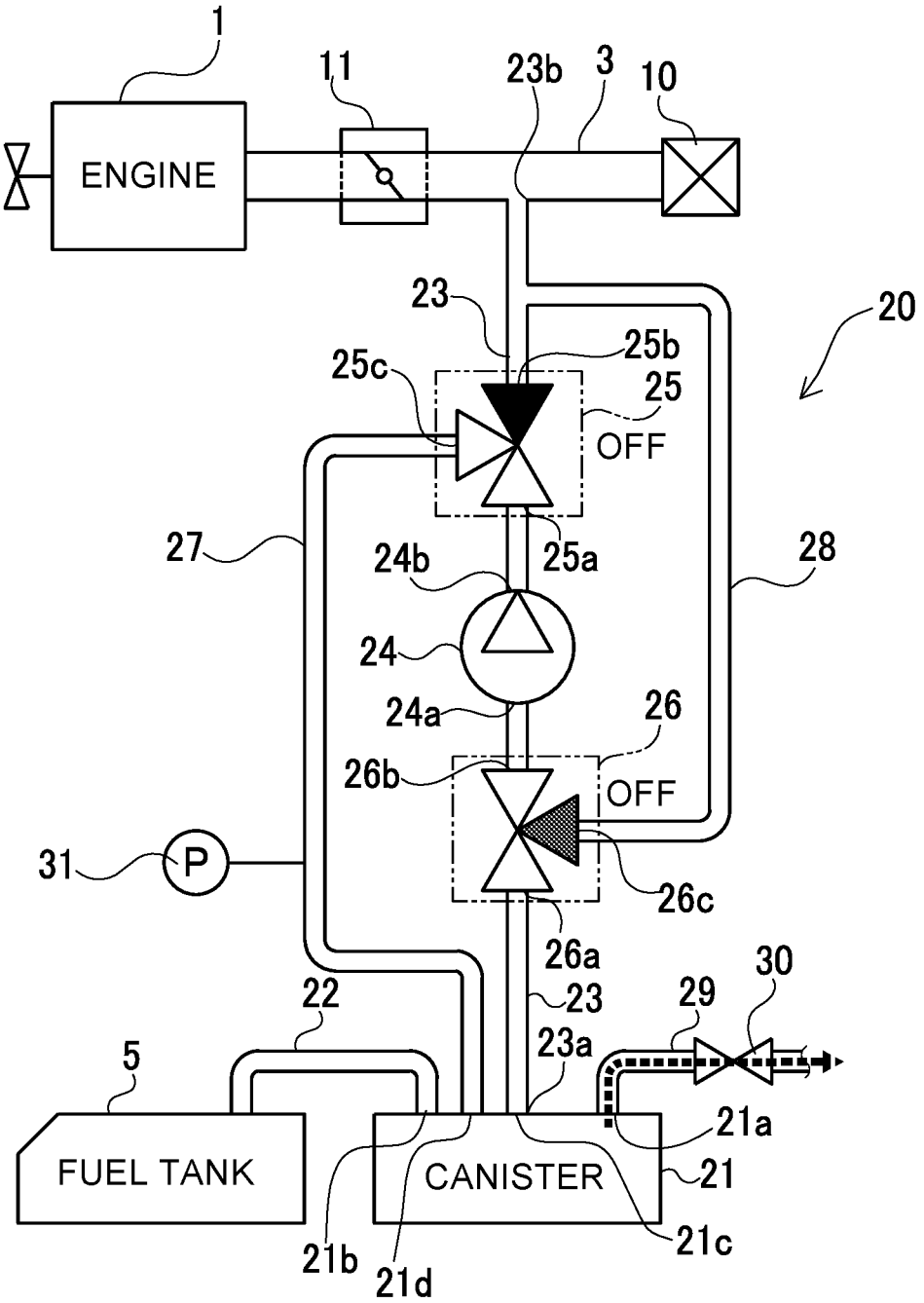
FIG. 6 is a schematic configurational view of the engine system including the evaporated fuel processing apparatus of the present embodiment, illustrating an air discharge process.

As shown in FIG. 1, the engine system of the present embodiment includes an ECU 32. This ECU 32 is one example of a controller of the evaporated fuel processing apparatus 20 according to the present embodiment. The ECU 32 is provided with the known configuration including a central processing unit (CPU), a read-only-memory (ROM), a random-access-memory (RAM), a backup RAM, and others. The ROM stores predetermined control programs related to various controls in advance. The ECU (CPU) 32 is configured to carry out the various controls according to these control programs. In the present embodiment, the ECU 32 controls the engine 1, the purge pump 24, the first trifurcated valve 25, the second trifurcated valve 26, the DCV 30, and others, and also controls the evaporated fuel processing apparatus 20. The ECU 32 further receives information of detected values of the pressure sensor 31 from the pressure sensor 31. For simplifying the explanation, the ECU 32 is omitted in FIGS. 3, 4, and 6 which will be explained below.

In the thus configured evaporated fuel processing apparatus 20 in the purge control process, as shown in FIG. 1, the ECU 32 sets the first trifurcated valve 25 and the second trifurcated valve 26 (switching valves) to a purge mode by turning on the first trifurcated valve 25 and turning off the second trifurcated valve 26. To be more specific, the ECU 32 controls the first trifurcated valve 25 such that the discharge port 24*b* of the purge pump 24 is communicated with the intake passage 3 via the purge passage 23 and controls the second trifurcated valve 26 such that the intake port 24*a* of the purge pump 24 is communicated with the canister 21 via the purge passage 23. The ECU 32 further controls the DCV 30 to open and drives the purge pump 24. By this control of the ECU 32, the purge gas in the canister 21 is pressure-fed to the intake passage 3 via the purge passage 23. At this time, the purge gas having flown into the purge passage 23 from the canister 21 further flows in the purge passage 23 and then flows into the intake passage 3 through the second trifurcated valve 26, the purge pump 24, and the first trifurcated valve 25 as shown in FIG. 1.

(Residual Purge Gas Processing Operation)

The purge control is carried out as mentioned above, but during halt of the purge control, the purge gas remains in the purge passage 23. During this halt of the purge control, accordingly, the evaporated fuel included in the purge gas remaining in the purge passage 23 (hereafter, simply "residual purge gas") may leak out to the atmosphere.

To address this, the ECU 32 performs residual purge gas processing operation of bringing back the residual purge gas to the canister 21 and making the evaporated fuel included in the residual purge gas adsorbed by the adsorbent provided in the canister 21 during halt of the purge control. At this time, the ECU 32 of the present embodiment prevents the evaporated fuel from being discharged outside the canister 21.

Figure 2:
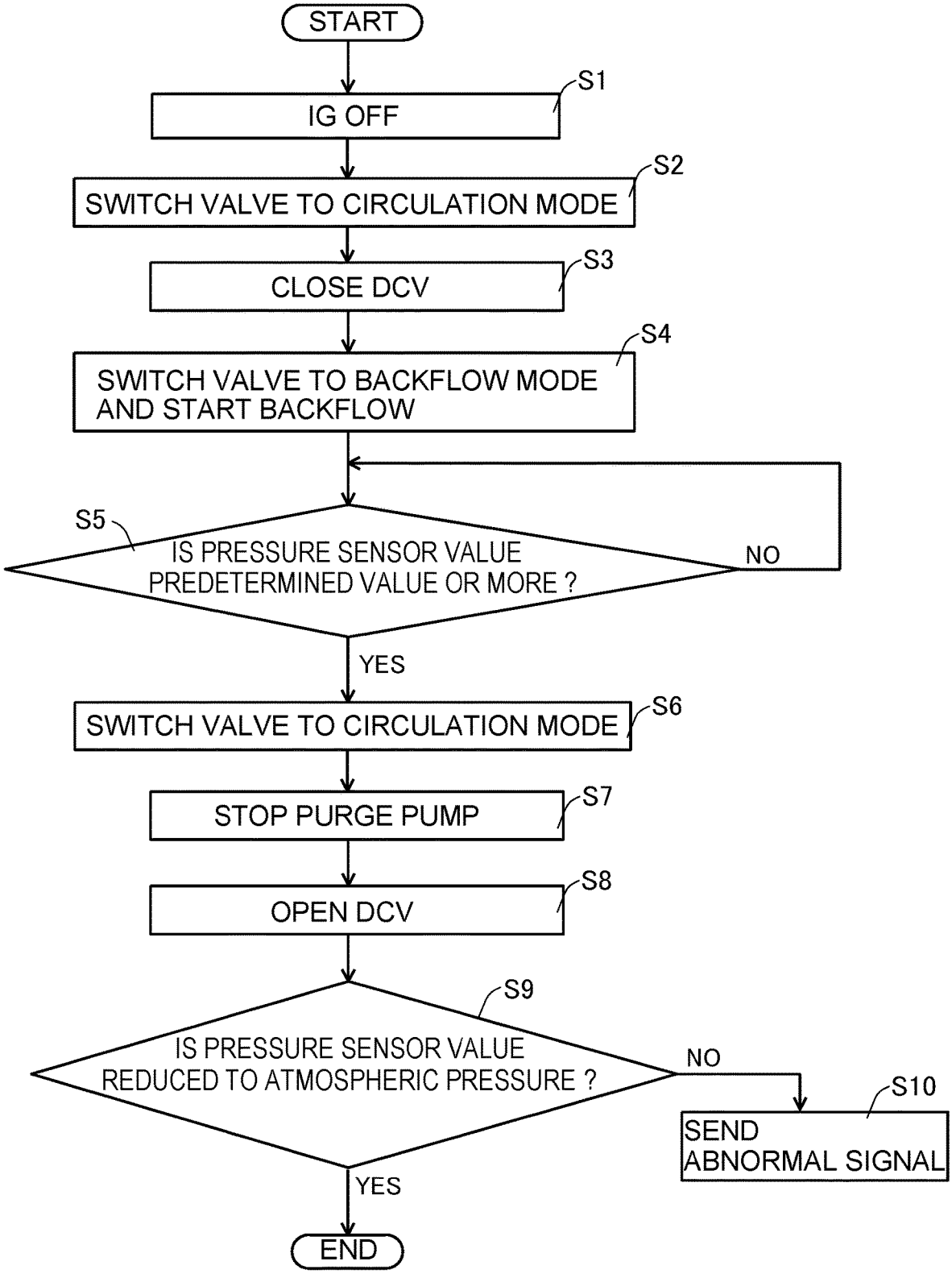
FIG. 2 is a flowchart showing contents of residual purge gas processing operation performed in the present embodiment.

Specifically, the ECU 32 carries out the residual purge gas processing operation according to contents of a flow chart shown in FIG. 2 at a predetermined timing after an ignition switch provided in a vehicle mounted with the evaporated fuel processing apparatus 20 is turned off. This "predetermined timing" is specified as, for example, one hour from the first residual purge gas processing operation to the second residual purge gas processing operation, and two hours from the second residual purge gas processing operation to the third residual purge gas processing operation.

Figure 3:
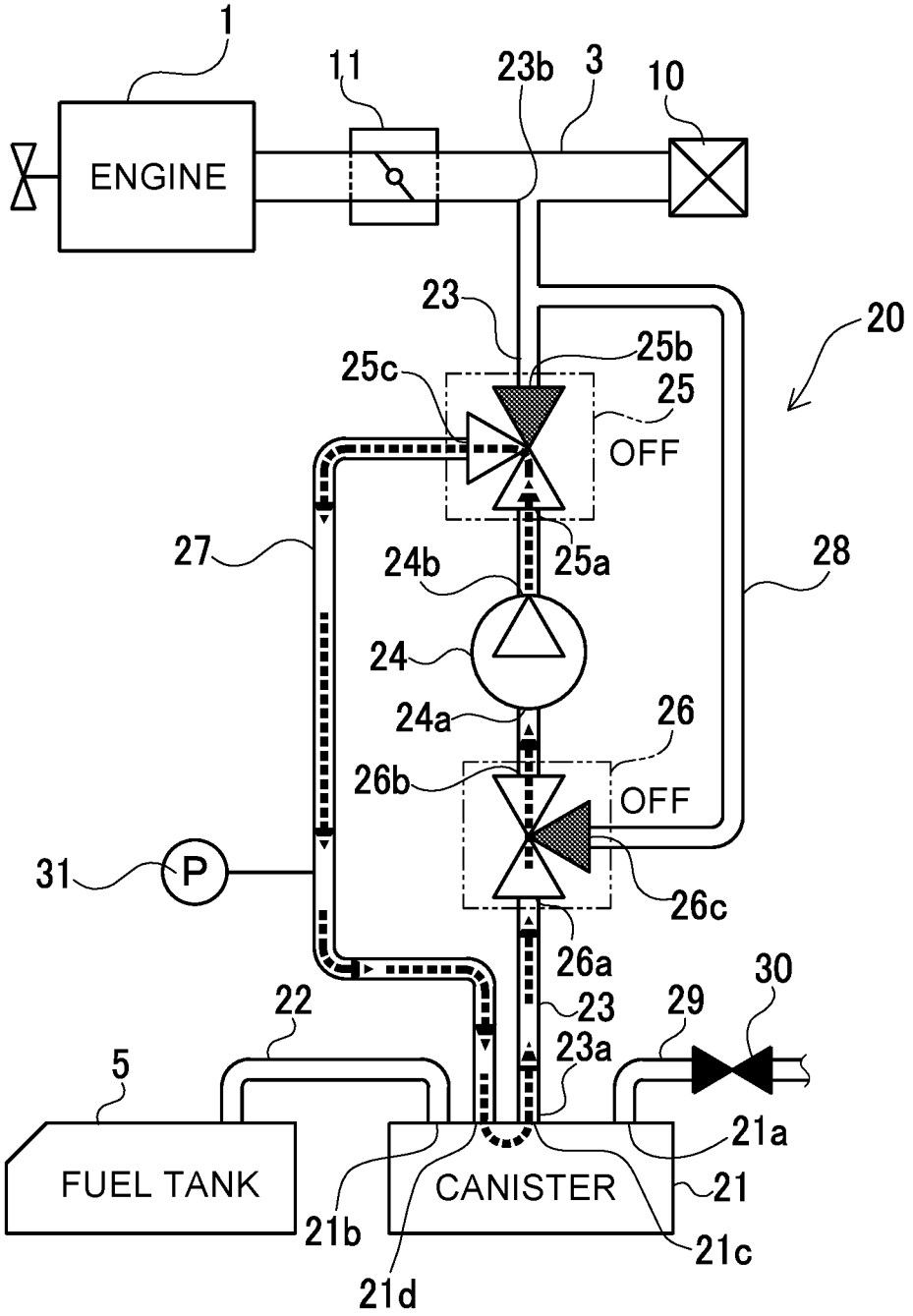
FIG. 3 is a schematic configurational view of the engine system including the evaporated fuel processing apparatus of the present embodiment, illustrating a purge gas circulation process.

As shown in FIG. 2, after the ignition switch (IG) is turned off (step S1), the ECU 32 sets the first trifurcated valve 25 and the second trifurcated valve 26 (switching valves) to the circulation mode (step S2). Specifically, the ECU 32 turns off both the first trifurcated valve 25 and the second trifurcated valve 26 as shown in FIG. 3. Thus, the purge control is assuredly halted. In other words, even when the purge control still continues after turning off the ignition switch (IG) (step S1), the purge control is halted by setting the first trifurcated valve 25 and the second trifurcated valve 26 (switching valves) to the circulation mode (step S2).

Figure 4:
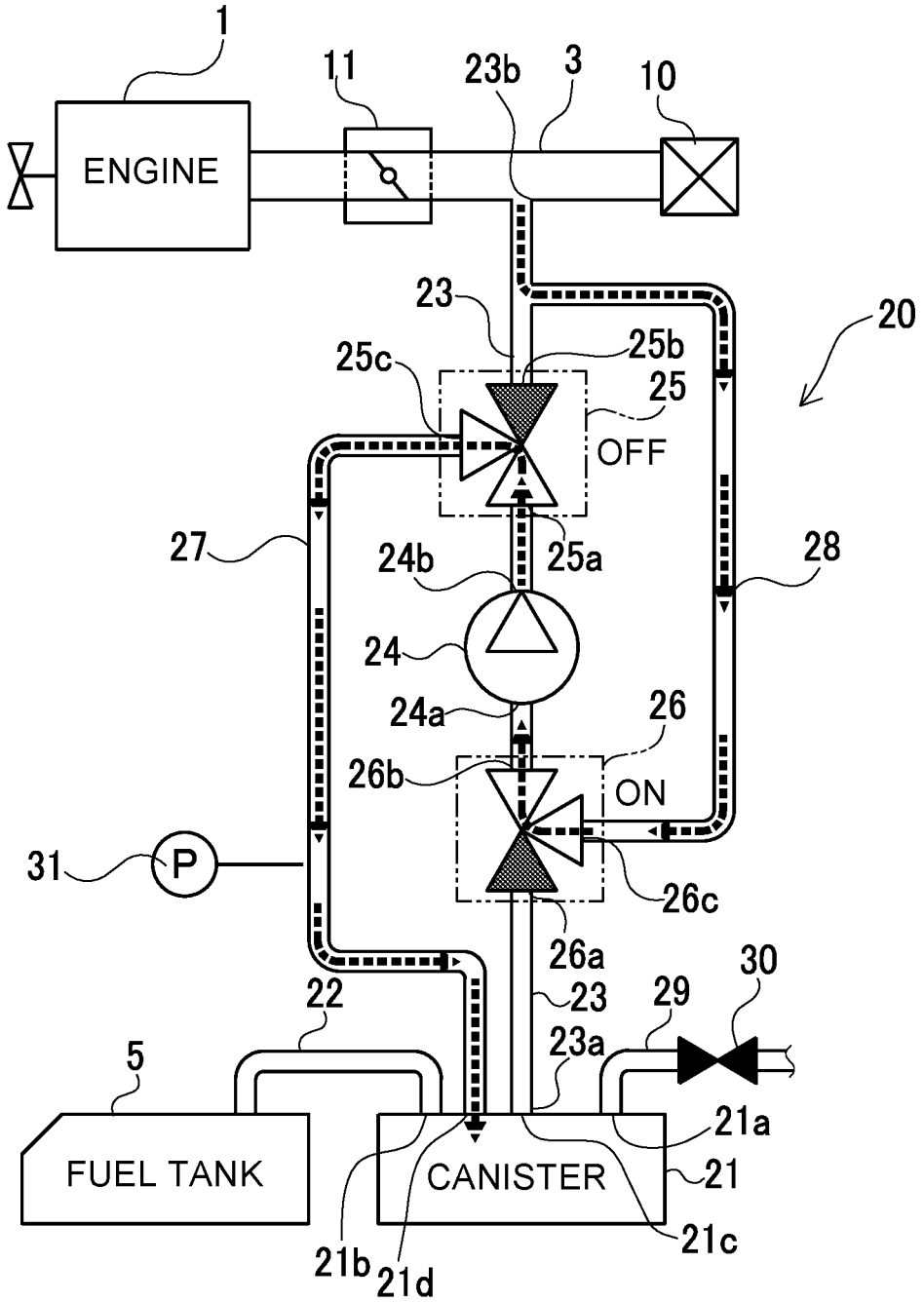
FIG. 4 is a schematic configurational view of the engine system including the evaporated fuel processing apparatus of the present embodiment, illustrating a residual purge gas pressure-feeding process.

During this halt of the purge control, the ECU 32 closes the DCV (a shut off valve) 30 (step S3) and sets the first trifurcated valve 25 and the second trifurcated valve 26 (switching valves) to a backflow mode so that backflow of the residual purge gas starts (step S4). To be more specific, the ECU 32 closes the DCV 30, turns off the first trifurcated valve 25, turns on the second trifurcated valve 26, and drives the purge pump 24 as shown in FIG. 4. This operation leads to flow of the residual purge gas with the air (intake air), which has flown from the intake passage 3, to the canister 21 as indicated with a broken arrow in FIG. 4.

As mentioned above, the ECU 32 of the present embodiment firstly carries out the residual purge gas pressure-feeding process of pressure-feeding the residual purge gas with the air having flown from the intake passage 3 into the canister 21 as the residual purge gas processing operation. In this residual purge gas pressure-feeding process, the ECU 32 closes the DCV (shut off valve) 30 to shut off the atmospheric passage 29, turns off the first trifurcated valve 25 to communicate the purge passage 23 with the first bypass passage 27, and turns on the second trifurcated valve 26 to open an air introduction passage (the purge passage 23 and the second bypass passage 28).

Herein, the air introduction passage is a passage for introducing the air (intake air) from the intake passage 3 to the purge pump 24. This air introduction passage is constituted of the purge passage 23 extending from the intake passage 3 (the outflow port 23*b* of the purge passage 23) to the first trifurcated valve 25, the second bypass passage 28, the second trifurcated valve 26, and the purge passage 23 extending from the second trifurcated valve 26 to the intake port 24*a* of the purge pump 24.

In the above state, the ECU 32 then controls the purge pump 24 to pressure-feed the residual purge gas with the air to the canister 21. Specifically, the ECU 32 drives the purge pump 24 to pressure-feed the residual purge gas with the air from the purge passage 23 to the purge pump 24 through the second bypass passage 28, the second trifurcated valve 26, and the purge passage 23 as indicated with the broken arrow in FIG. 4, and further pressure-feed the purge gas with the air from the purge pump 24 to the canister 21 through the purge passage 23, the first trifurcated valve 25, and the first bypass passage 27.

In this residual purge gas pressure-feeding process, the DCV 30 is closed and accordingly the atmospheric passage 29 is shut off, thus preventing the air from being discharged out of the canister 21 through the atmospheric passage 29. As a result, inside of the canister 21 is pressurized. Further, inside the first bypass passage 27 communicating with the canister 21 is also pressurized.

Subsequently, when a detected value (a pressure sensor value) of the pressure sensor 31 becomes a predetermined value or more (step S5: YES), the ECU 32 sets the first trifurcated valve 25 and the second trifurcated valve 26 (switching valves) to the circulation mode (step S6). Namely, when the purge pump 24 pressure-feeds the residual purge gas and the air each having predetermined volume to pressurize the inside of the canister 21 and the inside of the first bypass passage 27 to be the predetermined value or more, the ECU 32 turns off both the first trifurcated valve 25 and the second trifurcated valve 26 as shown in FIG. 3. In this step, the ECU 32 closes the DCV 30 and drives the purge pump 24.

This operation causes the purge gas (including the residual purge gas) and the air to circulate each passage and inside the canister 21 as indicated with a broken arrow in FIG. 3 (purge gas circulation process). At this time, the pressure inside the canister 21 is kept pressurized to be the predetermined value or more.

The predetermined value in step S5 is, for example, a backflow mode completion pressure value P1 as defined in a table of FIG. 5. As shown in FIG. 5, the backflow mode completion pressure value P1 is, for example, defined according to an amount of fuel (fuel amount) in the fuel tank 5 and a backflow rate (a pressure-feeding amount of the residual purge gas and the air) on an assumption that a volume of the fuel tank 5 (tank volume) is a predetermined amount (for example, 60 L) and other amounts (volume of the canister 21 and the pipe) are predetermined values (for example, 2 L). To be specific, as shown in FIG. 5, the more the fuel amount in the fuel tank 5 is, the higher the backflow mode completion pressure value P1 is set.

As mentioned above, the ECU 32 determines whether pressure-feeding of the residual purge gas and the air of the predetermined volume by the purge pump 24 is completed based on the detected value of the pressure sensor 31 (the pressure detected value in the first bypass passage 27) in the residual purge gas pressure-feeding process. When the detected value of the pressure sensor 31 becomes the predetermined value or more, the ECU 32 determines that pressure-feeding of the residual purge gas and the air of the predetermined volume by the purge pump 24 has been completed. At this time, the more the fuel amount of the fuel tank 5 is, the higher the predetermined value is set.

Returning to the explanation of FIG. 2, the ECU 32 subsequently halts the purge pump 24 (step S7) and then opens the DCV 30 (shutoff valve) (step S8). Thus, the air inside the canister 21 is discharged out through the atmospheric passage 29 as indicated with a broken arrow in FIG. 6, so that the inside of the canister 21 is depressurized.

As mentioned above, in the present embodiment, the ECU 32 carries out the residual purge gas processing operation by pressure-feeding the residual purge gas and the air of the predetermined volume by the purge pump 24 to pressurize the canister 21 in the above-mentioned residual purge gas pressure-feeding process and then performing the air discharge process. In the air discharge process, the ECU 32 turns off the first trifurcated valve 25 and turns off the second trifurcated valve 26 to shut off the air introduction passage (the purge passage 23 and the second bypass passage 28), and the ECU 32 opens the DCV 30 to open the atmospheric passage 29 in this state. Accordingly, in the air discharge process, the air inside the canister 21 is discharged outside through the atmospheric passage 29.

The above-mentioned discharge of the air inside the pressurized canister 21 to the outside (atmosphere) through the atmospheric passage 29 leads to increase in the flow speed of the air and decrease in discharge time of the air. Accordingly, heat conduction from the air to the adsorbent in the canister 21 is restrained, so that the temperature of the adsorbent becomes hard to increase. Desorption of the evaporated fuel from the adsorbent in the canister 21 is thus restrained, so that the evaporated fuel is hardly discharged outside from the canister 21 through the atmospheric passage 29. Therefore, the evaporated fuel can be prevented from being discharged outside from the canister 21 when the residual purge gas processing operation is carried out.

Further, in the present embodiment, the ECU 32 halts the purge pump 24 (step S7) when the detected value of the pressure sensor 31 (the pressure sensor value) becomes the predetermined value or more (step S5: YES). Accordingly, unnecessary driving of the purge pump 24 and unnecessary pressurizing of the canister 21 can be prevented. This can achieve prevention of unnecessary electricity consumption and heat generation which are to be required for driving the purge pump 24 and also achieve prevention of decrease in the lifetime of a canister case (for example, made of resin).

Returning to the explanation of FIG. 2, when the detected value of the pressure sensor 31 decreases to the atmospheric pressure (step S9: YES), the ECU 32 once terminates the process illustrated in the flow chart of FIG. 2 and the residual purge gas processing operation is ended.

Herein, when the detected value of the pressure sensor 31 does not decrease to the atmospheric pressure (step S9: NO), the ECU 32 sends an abnormality signal (step S10). Further, the ECU 32 may send the abnormality signal in step S5 when the detected value of the pressure sensor 31 does not reach the predetermined value even after a predetermined period of time has elapsed.

As mentioned above, the ECU 32 performs leakage detection of purge gas (including the residual purge gas) and the air in a pump downstream-side pressure-feeding route which will be explained later and/or malfunction detection of at least any one of the first trifurcated valve 25, the second trifurcated valve 26, and the DCV 30 based on the detected value of the pressure sensor 31. When the ECU 32 detects any leakage or malfunction, the ECU 32 sends an abnormality signal. Herein, the pump downstream-side pressure-feeding route is a route constituted by the purge passage 23 between the purge pump 24 and the first trifurcated valve 25, the first bypass passage 27, the canister 21, and the atmospheric passage 29 between the canister 21 and the DCV 30.

Figure 7:
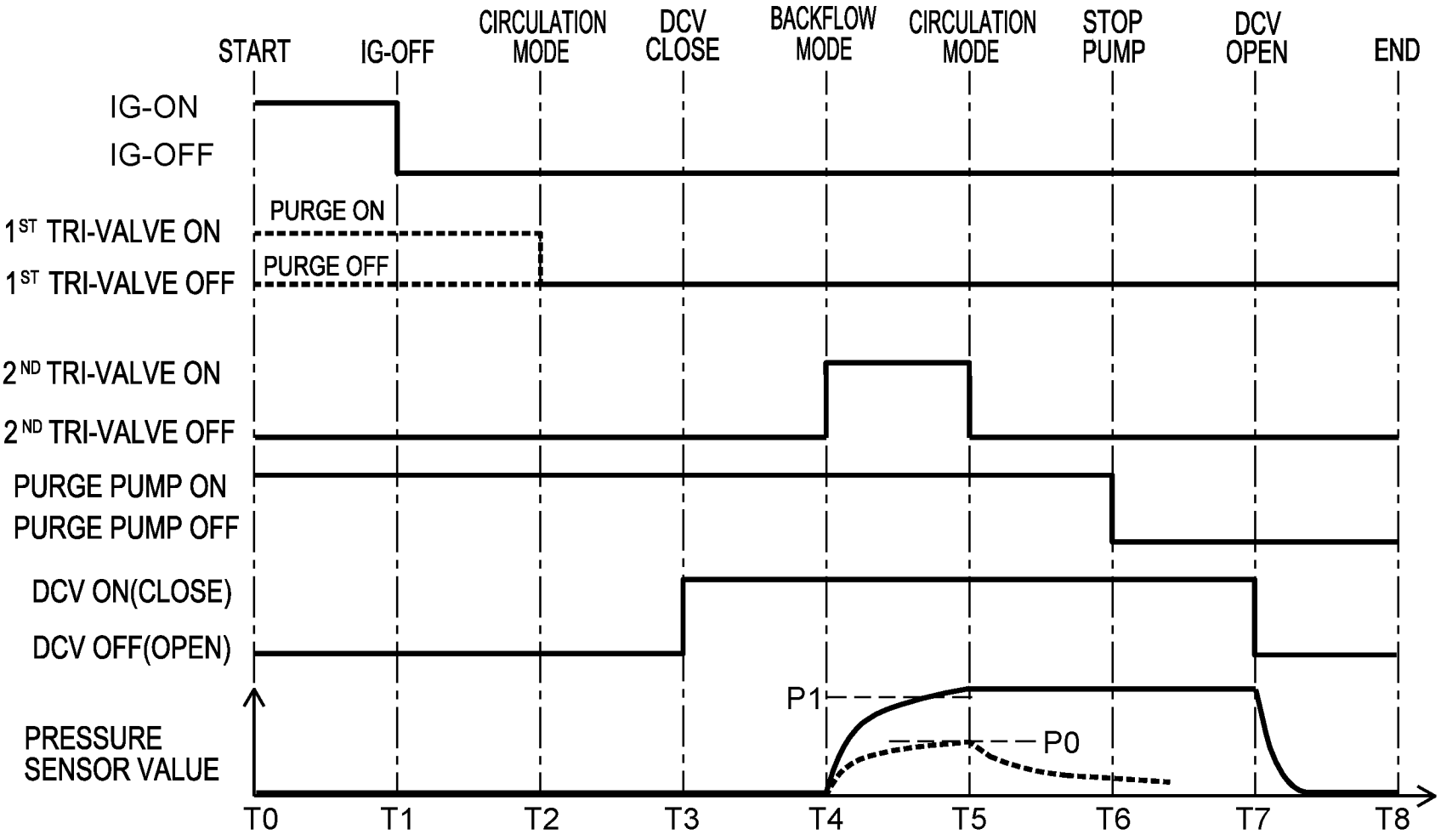
FIG. 7 is a time chart showing contents of the residual purge gas processing operation carried out in the present embodiment.

By performing the control according to the flow chart of FIG. 2, one example of control as illustrated in a time chart of FIG. 7 is executed.

As shown in FIG. 7, the control starts at time T0. The ignition switch (IG) is tuned off at time T1, and the first trifurcated valve 25 and the second trifurcated valve 26 are set in the circulation mode at time T2. Namely, at time T2, both the first trifurcated valve 25 and the second trifurcated valve 26 are turned off. The purge control is thus assuredly halted. On the other hand, the purge pump 24 has been kept on since time T0 and kept driven.

Subsequently, the DCV 30 is set in a valve-closing state (turned on) at time T3, and the first trifurcated valve 25 and the second trifurcated valve 26 are set in the backflow mode at time T4. In other words, at time T4, the first trifurcated valve 25 is turned off and the second trifurcated valve 26 is turned on.

This leads to increase in the detected value of the pressure sensor 31 (the pressure sensor value) thereafter, and at time T5, the detected value of the pressure sensor 31 becomes the backflow mode completion pressure value P1 or more. Accordingly, the first trifurcated valve 25 and the second trifurcated valve 26 are set in the circulation mode. In other words, both the first trifurcated valve 25 and the second trifurcated valve 26 are turned off at time T5. At this time, the inside of the canister 21 is being pressurized.

When the detected value of the pressure sensor 31 does not increase much to be less than the backflow mode completion pressure value P1 and also equal to or less than a malfunction detection determination value P0 at time T5, the ECU 32 sends an abnormality signal. To be more specific, at time T5, when the detected value of the pressure sensor 31 is equal to or less than the malfunction detection determination value P0, the ECU 32 determines there may be occurred leakage of purge gas and the air in the pump downstream-side pressure-feeding route or may be occurred malfunction of at least any one of the first trifurcated valve 25, the second trifurcated valve 26, and the DCV 30. The ECU 32 accordingly gives a corresponding abnormality signal.

After that, at time T6, the purge pump 24 is turned off and halted, but the detected value of the pressure sensor 31 is unchanged from the backflow mode completion pressure value P1 or more.

After that, at time T7 when the DCV 30 is in a valve-opening state (turned off), the detected value of the pressure sensor 31 decreases to be a value of the atmospheric pressure and the control is terminated at time T8. At this time, the air is discharged outside (to the atmosphere) through the atmospheric passage 29 from the pressurized canister 21.

When the detected value of the pressure sensor 31 fails to decrease to the value of the atmospheric pressure at time T8, the ECU 32 gives an abnormality signal as similar to the case of time T5.

(Operations and Effects of Present Embodiment)

In the evaporated fuel processing apparatus 20 of the above-mentioned present embodiment, the ECU 32 performs the residual purge gas processing operation by returning the residual purge gas to the canister 21 and processing during halt of the purge control. The ECU 32 specifically performs the residual purge gas pressure-feeding process and the air discharge process as the residual purge gas processing operation.

In this operation, the ECU 32 firstly closes the atmospheric passage 29 and opens the air introduction passage (the purge passage 23 and the second bypass passage 28), and in this state, the ECU 32 further controls the purge pump 24 to pressure-feed the residual purge gas into the canister 21 with the air (intake air) which has flown from the intake passage in the residual purge gas pressure-feeding process.

The ECU 32 thus pressure-feeds the residual purge gas and the air of a predetermined volume by the purge pump 24 in the residual purge gas pressure-feeding process, and then opens the atmospheric passage 29 while the air introduction passage (the purge passage 23 and the second bypass passage 28) is shut off. In this state, the air inside the canister 21 is discharged outside through the atmospheric passage 29 in the air discharge process.

As mentioned above, in the present embodiment, the residual purge gas is pressure-fed into the canister 21 while the atmospheric passage 29 is shut off in the residual purge gas pressure-feeding process, so that the evaporated fuel is prevented from being discharged outside from the canister 21 through the atmospheric passage 29.

Further, the residual purge gas and the air are both pressure-fed into the canister 21 to pressurize the inside of the canister 21 while the atmospheric passage 29 is shut off in the residual purge gas pressure-feeding process, and thereafter, the atmospheric passage 29 is opened in the air discharge process to discharge the air outside from the canister 21 via the atmospheric passage 29. Accordingly, in the air discharge process, the flow speed of the air is increased and the discharge time of the air is shortened, thus restraining heat conduction from the air to the adsorbent of the canister 21, so that the temperature of the adsorbent is hard to increase. This achieves prevention of the evaporated fuel's desorption from the adsorbent in the canister 21, and thus the evaporated fuel is hard to be discharged outside through the atmospheric passage 29 from the canister 21 in the air discharge process. As a result of this, when the residual purge gas is made to return to the canister 21 and processed, the evaporated fuel can be prevented from being discharged outside the canister 21.

The evaporated fuel processing apparatus 20 of the present embodiment further includes the purge pump 24 to pressure-feed the purge gas only in one direction from the intake port 24*a* to the exhaust port 24*b*. The ECU 32 then controls the first trifurcated valve 25 to communicate the exhaust port 24*b* of the purge pump 24 with the intake passage 3 via the purge passage 23 and controls the second trifurcated valve 26 to communicate the intake port 24*a* of the purge pump 24 with the canister 21 via the purge passage 23 in the purge control process. In this state, the DCV 30 is controlled to open and the purge pump 24 is driven, thereby pressure-feeding the purge gas inside the canister 21 to the intake passage 3. The ECU 32 further controls the first trifurcated valve 25 to communicate the exhaust port 24*b* of the purge pump 24 with the canister 21 via the first bypass passage 27 and controls the second trifurcated valve 26 to communicate the intake port 24*a* of the purge pump 24 with the intake passage 3 via the second bypass passage 28 in the residual purge gas pressure-feeding process. In this state, the DCV 30 is closed and the purge pump 24 is driven to pressure-feed the residual purge gas into the canister 21.

As mentioned above, the purge pump 24 for pressure-feeding the purge gas only in one direction is used to pressure-feed the purge gas inside the canister 21 into the intake passage 3 and further to pressure-feed the residual purge gas in the purge passage 23 into the canister 21. Accordingly, the configuration of the evaporated fuel processing apparatus 20 is simplified and switching operation of pressure-feeding directions of the purge gas can be made in a short time.

In the present embodiment, the ECU 32 further determines whether pressure-feeding of the residual purge gas and the air of the predetermined volume by the purge pump 24 is completed based on the detected value of the pressure sensor 31 in the residual purge gas pressure-feeding process.

This operation achieves regulation of the flow rate of the residual purge gas and the air which are to be pressure-fed to the canister 21 and achieves pressurizing of the canister 21 to the desired pressure value.

Further, in the present embodiment, the ECU 32 determines that pressure-feeding of the residual purge gas and the air of the predetermined volume by the purge pump 24 has completed when the detected value of the pressure sensor 31 becomes the predetermined value or more. Herein, the more the fuel amount in the fuel tank 5 connected to the canister 21 is, the higher the predetermined value is set.

Thus, the amount of the residual purge gas and the air which are pressure-fed to the canister 21 can be regulated according to the fuel amount in the fuel tank 5. Accordingly, the inside of the canister 21 can be stably pressurized to the desired pressure value irrespective of the fuel amount in the fuel tank 5.

Further, in the present embodiment, the ECU 32 performs the residual purge gas processing operation at a predetermined timing after the ignition switch provided in a vehicle mounted with the evaporated fuel processing apparatus 20 is turned off.

Thus, return operation of the residual purge gas to the canister 21 is repeated at a predetermined timing after turning off the ignition switch. Accordingly, the residual purge gas can be effectively removed from the purge passage 23. Further, the evaporated fuel to be discharged (leaked) out of the intake passage 3 (an injector or the like) can be returned to the canister 21 through the purge passage 23 and others from the intake passage 3, thus restraining the discharge amount of the evaporated fuel discharged to the atmosphere during vehicle parking.

The ECU 32 further performs leakage detection in the pump downstream-side pressure-feeding route and/or malfunction detection of at least any one of the first trifurcated valve 25, the second trifurcated valve 26, and the DCV 30 based on the detected value of the pressure sensor 31.

Thus, abnormality detection of the evaporated fuel processing apparatus 20 (control of on-board diagnostics (OBD)) can be performed.

When the regulation control of the flow rate of the residual purge gas and the air, which are to be pressure-fed into the canister 21, is performed based on the detected value of the pressure sensor 31, both the flow rate regulation of the residual purge gas and the air which are to be pressure-fed into the canister 21 and the abnormality detection of the evaporated fuel processing apparatus 20 can be carried out by the single pressure sensor 31. This can achieve simplification of the device configuration of the evaporated fuel processing apparatus 20.

The above embodiment is only an illustration and the present disclosure is not limited to the embodiment. It is to be therefore understood that various changes and modifications may be made without departing from the scope of the disclosure.

For example, the pressure sensor 31 may be placed on any position of the above-mentioned pump downstream-side pressure-feeding route other than the position on the first bypass passage 27.

REFERENCE SIGNS LIST

1 Engine
3 Intake passage
5 Fuel tank
20 Evaporated fuel processing apparatus
21 Canister
22 Vapor passage
23 Purge passage
24 Purge pump
24*a* Intake port
24*b* Exhaust port
25 First trifurcated valve
26 Second trifurcated valve
27 First bypass passage
28 Second bypass passage
29 Atmospheric passage
30 DCV
31 Pressure sensor
32 ECU

What is claimed is:

1. An evaporated fuel processing apparatus comprising:
a canister provided with an adsorbent to adsorb evaporated fuel generated in a fuel tank;
a purge passage connected to an intake passage, which is connected to an internal combustion engine, and a canister; and
a controller to carry out purge control of feeding purge gas including the evaporated fuel into the intake passage from the canister via the purge passage, wherein
the apparatus includes:
a pressure-feeding part;
an air introduction passage to introduce the air from the intake passage to the pressure-feeding part; and
an atmospheric passage having one end connected to the canister and the other end opening in the atmosphere,
the controller is configured to perform residual purge gas processing operation by returning the residual purge gas that is the purge gas remaining in the purge passage and processing during halt of the purge control,
the residual purge gas processing operation includes:
a residual purge gas pressure-feeding process of pressure-feeding the residual purge gas with the air into the canister by the pressure-feeding part in a state in which the atmospheric passage is shut off and the air introduction passage is opened; and
an air discharge process of discharging the air from the canister to the outside through the atmospheric passage by opening the atmospheric passage in a state in which the air introduction passage is shut off after the residual purge gas and the air of predetermined volume are pressure-fed by the pressure-feeding part in the residual purge gas pressure-feeding process.

2. The evaporated fuel processing apparatus according to claim 1, wherein
the pressure-feeding part is a purge pump provided in the purge passage to pressure-feed the purge gas in one direction from an intake port to an exhaust port,
the evaporated fuel processing apparatus comprises:
a first trifurcated valve provided in the purge passage between the exhaust port of the purge pump and the intake passage;
a second trifurcated valve provided in the purge passage between the intake port of the purge pump and the canister;
a first bypass passage detouring the purge pump between the first trifurcated valve and the canister;
a second bypass passage detouring the purge pump between the purge passage, which is located between the first trifurcated valve and the intake passage, and the second trifurcated valve; and
an atmospheric passage open/close valve provided in the atmospheric passage to open and close the atmospheric passage,
the controller controls the atmospheric passage open/close valve to open and controls the purge pump to drive such that the purge gas inside the canister is pressure-fed to the intake passage in a state in which the exhaust port of the purge pump is communicated with the intake passage via the purge passage by the first trifurcated valve and the intake port of the purge pump is communicated with the canister via the purge passage by the second trifurcated valve in the purge control process of carrying out the purge control, and
the controller controls the atmospheric passage open/close valve to close and controls the purge pump to drive such that the residual purge gas is pressure-fed to the canister in a state in which the exhaust port of the purge pump is communicated with the canister via the first bypass passage by the first trifurcated valve, and the intake port of the purge pump is communicated with the intake passage via the second bypass passage by the second trifurcated valve in the residual purge gas pressure-feeding process.

3. The evaporated fuel processing apparatus according to claim 2, wherein
when a route formed by the purge passage between the purge pump and the first trifurcated valve, the first bypass passage, the canister, and the atmospheric passage between the canister and the atmospheric passage open/close valve is defined as a pump downstream-side pressure-feeding route,
the controller determines whether pressure-feeding of the residual purge gas and the air of predetermined volume by the purge pump in the residual purge gas pressure-feeding process is completed based on a pressure detected value detected in the pump downstream-side pressure-feeding route.

4. The evaporated fuel processing apparatus according to claim 3, wherein
the controller determines completion of pressure-feeding of the residual purge gas and the air of the predetermined volume by the purge pump when the pressure detected value is equal to or more than a predetermined value, and
the more a fuel amount in the fuel tank connected to the canister is, the higher the predetermined value is set.

5. The evaporated fuel processing apparatus according to claim 1, wherein the controller performs the residual purge gas processing operation at a predetermined timing after an ignition switch provided in a vehicle mounted with the evaporated fuel processing apparatus is turned off.

6. The evaporated fuel processing apparatus according to claim 2, wherein when a route formed by the purge passage between the purge pump and the first trifurcated valve, the first bypass passage, the canister, and the atmospheric passage between the canister and the atmospheric passage open/close valve is defined as a pump downstream-side pressure-feeding route, the controller performs at least any one of leakage detection in the pump downstream-side pressure-feeding route and malfunction detection of at least any one of the first trifurcated valve, the second trifurcated valve, and the atmospheric passage open/close valve based on a pressure detection value in the pump downstream-side pressure feeding route.

7. The evaporated fuel processing apparatus according to claim 2, wherein the controller performs the residual purge gas processing operation at a predetermined timing after an ignition switch provided in a vehicle mounted with the evaporated fuel processing apparatus is turned off.

8. The evaporated fuel processing apparatus according to claim 3, wherein the controller performs the residual purge gas processing operation at a predetermined timing after an ignition switch provided in a vehicle mounted with the evaporated fuel processing apparatus is turned off.

9. The evaporated fuel processing apparatus according to claim 4, wherein the controller performs the residual purge gas processing operation at a predetermined timing after an ignition switch provided in a vehicle mounted with the evaporated fuel processing apparatus is turned off.

* * * * *